US012680328B2

(12) United States Patent
Halvorsen et al.

(10) Patent No.: US 12,680,328 B2
(45) Date of Patent: Jul. 14, 2026

(54) PROGRAMMABLE PRESSURIZED WATER DISTRIBUTION APPARATUS FOR IN-FLOOR POOL CLEANING SYSTEMS USING ELECTRICALLY CONTROLLED VALVES

(71) Applicant: POOL GAZOO, Flagler Beach, FL (US)

(72) Inventors: Leif Arthur Halvorsen, Palm Coast, FL (US); Leif Anker Halvorsen, Jr., Newark, NJ (US)

(73) Assignee: POOL GAZOO, Flagler Beach, FL (US)

( * ) Notice: Subject to any disclaimer, the term of this patent is extended or adjusted under 35 U.S.C. 154(b) by 282 days.

(21) Appl. No.: 18/518,158

(22) Filed: Nov. 22, 2023

(65) Prior Publication Data

US 2024/0191534 A1 Jun. 13, 2024

Related U.S. Application Data

(60) Provisional application No. 63/453,422, filed on Mar. 20, 2023, provisional application No. 63/427,127, filed on Nov. 22, 2022.

(51) Int. Cl.
*E04H 4/16* (2006.01)
*E04H 4/12* (2006.01)

(52) U.S. Cl.
CPC ..... *E04H 4/169* (2013.01); *E04H 4/1236* (2013.01)

(58) Field of Classification Search
CPC ..... E04H 4/169; E04H 4/1236
See application file for complete search history.

(56) References Cited

U.S. PATENT DOCUMENTS

| | | | | |
|---|---|---|---|---|
| 5,262,936 | A | 11/1993 | Faris et al. | |
| 6,345,645 | B1 | 2/2002 | Kenna et al. | |
| 6,419,840 | B1 * | 7/2002 | Meincke | E04H 4/169 4/492 |
| 8,533,874 | B1 | 9/2013 | Goettl | |
| 2003/0085183 | A1 | 5/2003 | Mathews | |
| 2004/0210998 | A1 * | 10/2004 | Mathews | E04H 4/169 4/490 |

(Continued)

OTHER PUBLICATIONS

Zodiac, "Caretaker 8-port valve the powerhouse", 2017, www.caretakersystem.com, 24 pages.

*Primary Examiner* — Jennifer C Chiang
(74) *Attorney, Agent, or Firm* — John L. DeAngelis; Wolter Van Dyke Davis, PLLC

(57) ABSTRACT

An in-floor pool cleaning system for controllably directing pressurized water from a pump to surface regions of a pool or spa. The system comprises a plurality of zone outlets each terminating at a nozzle disposed in a surface of the pool or spa and each controlled to an opened condition responsive to a control signal supplied to an associated zone valve. A controller supplying the control signals to each valve according to a schedule that sets forth the opened-state time, the closed-state time, and the opened state duration for each zone valve. The valves are individually controllable. A normally-opened bypass outlet is controllable to a closed state when one or more of the zone valves is in an opened state, and controllable to an opened state to supply water to the pool responsive to detection of a system over-pressurization or a system loss of power.

18 Claims, 6 Drawing Sheets

(56) References Cited

U.S. PATENT DOCUMENTS

| | | | | |
|---|---|---|---|---|
| 2009/0089944 | A1 | 4/2009 | Griffin et al. | |
| 2010/0308241 | A1 | 12/2010 | Doyle et al. | |
| 2012/0227175 | A1* | 9/2012 | Ford | E04H 4/1218 4/490 |
| 2013/0007954 | A1 | 1/2013 | Sutton et al. | |
| 2022/0043467 | A1 | 2/2022 | van der Meijden | |
| 2022/0341202 | A1 | 10/2022 | Goettl et al. | |

* cited by examiner

PROGRAMMABLE PRESSURIZED WATER DISTRIBUTION APPARATUS FOR IN-FLOOR POOL CLEANING SYSTEMS USING ELECTRICALLY CONTROLLED VALVES

CROSS REFERENCE TO RELATED PATENT APPLICATIONS

The present application claims priority to the provisional patent application filed on Nov. 22, 2022 and assigned application No. 63/427,127 and to the provisional patent application filed on Mar. 20, 2022 and assigned application No. 63/453,422. Both of these applications are incorporated by reference herein.

FIELD OF THE INVENTION

Swimming pools require periodic maintenance in the form of cleaning, either manually or by using automated cleaning systems. This invention relates generally to in-floor cleaning systems for swimming pools, and more particularly, to an improved method and apparatus for sequentially routing pressurized water to the different zones that make up the in-floor cleaning system in pools so equipped.

BACKGROUND OF INVENTION

Typical in-floor cleaning systems for swimming pools operate much like a lawn sprinkler system by arranging nozzles in groups, called zones, throughout the entire floor of the swimming pool. Nozzles may also be included in the benches and steps of the swimming pool. The nozzles are installed into niches that are built into the horizontal surfaces of the pool floor, the benches, and the steps during the construction process.

A distribution system sequentially directs high pressure water from the pool pump to each of the zones in the system by way of a mechanical distribution valve. When a zone receives the high-pressure water from the distribution valve, each of its nozzles rises up out of the floor and directs a jet of water across the surface of the floor, bench, or step. The water spray agitates any dirt or sediment resting on the floor back into the pool water, where it will eventually find its way to an outlet, a drain or skimmer, then to a pool filter for removing the dirt and sediment from the pool water.

The water spray from each nozzle covers a pie-shaped segment of the pool surface. The nozzle rotates slightly each time it rises out of the floor, so that eventually a 360-degree area around the nozzle and extending several feet from the nozzle, is cleaned. Each nozzle is placed so that its serviceable area overlaps with its adjacent nozzle's serviceable areas. Similarly, each zone is placed so that its serviceable area overlaps with its adjacent zone's serviceable areas. Thus, when all the zones have cycled a sufficient number of times to clean the 360-degree serviceable areas around each nozzle in each zone, then the entire pool floor, including any benches and steps, will have been cleaned.

The activation of each zone is controlled by a distribution valve that sequentially directs pressurized water from the pool pump to each one of the zones. Typically, each zone is associated with a cylindrical chamber in fluid communication with the pressurized water from the pool pump. An impeller-driven rotatable mechanism directs water from the pump to each of the chambers and thus to each of the zones as it rotates from zone to zone and causes each zone to sequentially receive the pressurized water through its respective chamber. Zones are typically activated one at a time until all zones have received and directed the pressurized water to each nozzle within the zone. The cycle then repeats for a prescribed period of time until it is determined to have completed a sufficient number of cycles to accomplish a complete sweeping of the pool floor, as described above.

Such in-floor pool cleaning systems, as typical in the prior art, are controlled by a large circular pressure vessel that house the impeller and gear reduction assembly that rotates a baseplate centered on the vessel's vertical axis. The circular pressure vessel has an array of usually six outlet ports arranged around the bottom of the vessel, where each of the six ports provides access to a single floor cleaning zone.

Pressurized water entering the pressure vessel from the pool pump pressurizes the vessel and is initially directed, upon entering the vessel, to drive an impeller that in-turn drives a gear reduction assembly that in turn drives a rotatable baseplate assembly. The base plate rotates a cam that moves from zone to zone, opening each zone in sequence, so that each zone sequentially receives the pressurized water within the vessel. The pressurized water then flows to the nozzles in each zone. As described above, the nozzles rotatably rises up from the floor and directs a stream of pressurized water across the surface of the floor to force any settled debris into suspension within the pool water. Each zone, and the nozzles associated with it, is sequentially activated to clean its assigned region of the pool floor. The process continues, always returning to the first zone, and cycles repeatedly for a prescribed period of time.

Another controller, referred to commercially as a Caretaker™ 8-port valve (a trademark of Zodiac Pool Systems, Inc.) relies on an electric motor to drive the rotatable mechanism, instead of a conventional water driven impeller as described above. However, the Caretaker™ system, unlike the present invention, does not use electronically actuated valves to activate different cleaning zones in the in-floor cleaning system. The Caretaker™ system is essentially a conventional mechanical distribution system using an electric motor power source instead of an impeller power source.

SUMMARY OF THE INVENTION

The present invention comprises an electronic and programmable controller to facilitate use of electrically actuated water valves to supply pressurized water to the different zones of a swimming pool in-floor cleaning system (IFCS), thereby eliminating the need for mechanical distribution valves typically used for such an application. Advantageously, the present invention saves energy and improves efficiency by adding programmability to contour individual zone run times to the actual time needed to satisfactorily perform a particular task.

The present invention also reduces maintenance costs by eliminating nearly all moving parts associated with the prior art mechanical distribution valves. The present invention also reduces the explosion hazard inherent with the use of the large pressure vessel by completely eliminating the mechanical distribution valve.

DETAILED DESCRIPTION OF THE INVENTION

Figure 1:
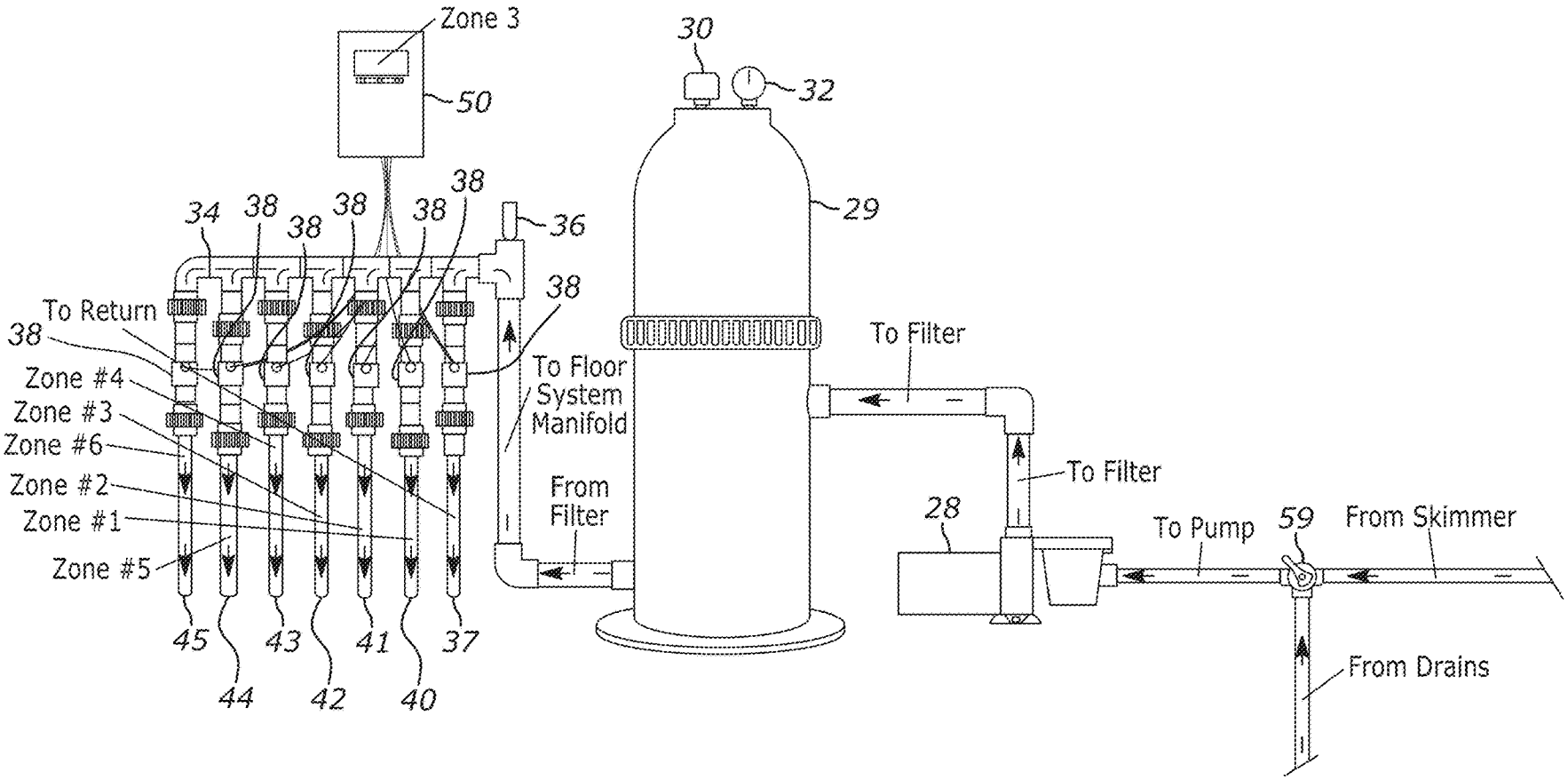
FIG. 1. represents components of a swimming pool in-floor cleaning system with six independent zones as controlled by a controller of the present invention.

The present invention operates by using a programmable electronica controller to replace the mechanical controllers typical of the prior art. The present invention facilitates the use of solenoid actuated water valves to control the distribution of pressurized water to the different zones that comprise the swimming pool's in-floor cleaning system, thereby eliminating the interaction of mechanical parts and reducing or eliminating the mechanical drag, wear and tear, maintenance, and energy costs associated with such mechanical controllers of the prior art.

The present invention relates to a novel and nonobvious system and method of controlling the distribution of pressurized water to the individual zones where instead of a prior art mechanical controller as described above, the system comprises a plurality of normally-closed solenoid actuated valves, one valve for each zone. Each valve is controlled to an opened state to supply pressurized water to each one of the zones. Operation is similar to the workings of a lawn sprinkler system. The valves are controlled by an electronic controller that directs each valve to open and close in a preprogrammed sequence, for a user-configurable period of time. The sequence may be altered simply by re-configuring the software of the device without the need for altering plumbing connections or changing the wiring of the valves.

The controller may also be programmed to direct a normally open bypass to remain closed, but then defaults to the open position in the event of an over pressurization due to a valve failing to open or in the event of any other occlusion that could cause an over pressurization of the system, such as a power failure to the controller itself. This is a redundant feature as most of the newer prior art variable speed pumps have high limit pressure switches that can shut down the pump in the event of over pressurization.

Unlike the controllers used in swimming pool in-floor cleaning systems of the prior art, however, the controller of the present invention is programmable so that each zone can be set to run for a length of time optimal for that zone. Some areas of the pool floor may tend to collect more debris and thus requires longer cleaning time than others. Steps and benches can be serviced in just a few seconds. Energy is saved, and efficiency optimized if a zone doesn't stay open beyond its efficacy. Each zone is further programmable so that an overlap time can be set to allow a smooth transition, pressure wise, from zone to zone. When a zone is activated, it remains open for the duration of its pre-programmed interval plus an additional few seconds beyond the opening of a subsequent zone. This allows for a lower pressure during transition due to the plurality (at least two) zones being open simultaneously while the transition is taking place. This overlap greatly reduces the pressure spikes typically seen in in-floor cleaning systems with mechanical distribution valves.

For pool circulation pumps that do not include overpressure protection, the IFCS (in-floor cleansing system) control module includes the capability to control a bypass valve. The software can be configured such that an unused output is designated to operate as a bypass valve of a "normally open" type, as opposed to the "normally closed" zone valves. When no zones are active, the bypass valve allows water to bypass the In-Floor Cleaning System zone valves, preventing an over pressure condition and damage to other vulnerable system components. When one or more zone valves are opened, the IFCS controller activates the bypass valve. This closes the bypass valve and directs the water flow into the zone valves. Upon power loss to the IFCS unit, the zone valves automatically close, and the bypass valve automatically opens.

The configuration of the present invention also incorporate yet another form of bypass as a safety measure to prevent over pressurization, that comprises a directional inlet in the wall of the pool that remains open concurrently while the in-floor system is in operation, and which directs bypass water to the pool, but which will have the increased capacity to carry the full load from the pump output in the event of a power loss and shut down of the controller itself while the pool pump might continue in operation. This wall inlet may also be directed to enhance the movement of water from an area of impeded water migration due to the pool's design features such as nooks and alcoves. A pump capable of moving larger volumes of water may facilitate a plurality of such bypasses.

The electronic and programmable nature of the present invention also affords the possibility to activate, deactivate, configure, and monitor the system in real time and from a remote location, if implemented with a microcontroller having wireless communication capabilities, e.g., Wi Fi or Bluetooth protocols. This "IoT" capability, means that the IFCS can integrate with a user's home network, allowing for system notifications and control from a cell phone or web browser interface. This type of connectivity and level of control is not possible with the mechanical systems of the prior art.

The present invention operates somewhat like the operating protocol of a lawn irrigation system, but with significant differences, including the controller of the present invention directing the cycle to repeat for an indefinite period of time to meet different needs for different regions of the in-floor swimming pool cleaning system. In the case of the lawn irrigation system, the needed action is but one cycle of the system on a given day; in other words once the lawn is irrigated, the task has been completed and the system turns off. Some lawn irrigation systems have as many as three programs, labeled A, B, and C, where a workaround of supplemental programing for "B" and "C" could produce two additional cycles in a single day. But these lawn irrigation systems do not offer a perpetual cycling of the system for a much longer period, as required for a swimming pool in-floor cleaning system where the action needed is to constantly, repetitively, and perpetually agitate the water near the pool floor so that debris that would otherwise settle to the bottom is prevented from doing so by the repetitive activation of the floor nozzles. Once the debris is suspended in the water column, it then enters one or more of the water intakes for filtering by the pool filter. The programmable feature of the present IFCS allows each zone outlets to be periodically activated to keep the debris suspended in the water.

Lawn irrigation systems are limited to a finite number of cycles because allowing a controller to continually cycle, whether by neglect or by design, results in a significant waste of water due to the fact that the water that is emitted from the nozzles in an irrigation system is lost after a single use. In this case water conservation is paramount and the controller and the programming of the controller seeks to accomplish the most effective irrigation of the target landscape while offering the lowest expense in terms of water use.

To the contrary, in a swimming pool in-floor cleaning system, the water used in the cleaning system is not lost and remains contained within the swimming pool's available water volume. The water used by the swimming pool in-floor cleaning system is continually used and re-used (recirculates) in perpetuity and always remains part of the original volume of water in the pool and therefore cycling limitations are not needed or useful.

Advantageously, each time a nozzle rises from the pool floor, the off-center aperture causes the nozzle to rotate slightly, sweeping a different sector of the floor directly in front of the nozzle orifice. Thus, after a number of cycles the nozzle will have made a complete rotation, all of the sectors will have been overlapped, and thus a 360-degree area around the nozzle, radiating outwardly for several feet will have been cleaned.

Another aspect of the electronic distribution valve controller of the present invention is to control a bypass which vents to the open pool. The bypass comprises a normally-opened electronically actuated valve which the controller holds closed so as to not bleed off pressure intended for the floor zones. But the bypass valve opens in the event of a power loss to the controller and the likely over pressurization that would occur where the zone valves default (on loss of power) to the closed position, but where the source pump remains in operation. The bypass intent is to prevent possible damage to the various components of the swimming pool plumbing system which are sensitive to higher pressures, such as the water heater and filter.

The present invention increases efficiency, thereby saving energy costs, since the cleaning operation in smaller zones within the pool floor or surface need not run as long as larger ones. It also lowers maintenance costs by eliminating the impeller and gear reduction systems that are prone to wear and tear, and by providing ease of maintenance with off-the-shelf parts that can be individually replaced. The present invention drastically reduces the risks of damage and personal injury by eliminating the explosion hazard inherent in the voluminous pressure vessels necessary to house the mechanical impeller and gear reduction systems typical of such controllers.

The present invention also saves wear and tear on most of the components that move water throughout the circulation system by reducing pressure spikes that can fatigue pipe, fittings, and cause fatigue and failure also of the filter, pump, and/or the heater, and all the other in-line components that comprise the water circulation system.

The present invention has utility as a retrofit for existing swimming pools equipped with in-floor cleaning systems due to its interchangeability with various brands of in-floor cleaning systems and may be incorporated into new construction where components by different vendors are desired.

The present invention can be used not only with dedicated high-head pumps, such as those used in certain lawn irrigation systems, but also with low-head pumps, such as those used in swimming pool circulation systems. Prior art mechanically-based in-floor cleaning systems would not be expected to function properly in a high-head pressure system due to possible damage to the mechanical elements. But the present invention does not include such mechanical zone-switching elements and thus can be operated with high-head pressure pumps.

The present invention could also be used to control lawn irrigation systems with added versatility in that sequential watering can be delivered and indefinitely repeated, but in the form of smaller doses in order to minimize runoff. Thus the unique features of the present invention can be employed advantageously in lawn irrigation systems.

Another aspect of the present invention is that the zones do not have to activate sequentially in that the programming will allow a plurality of zones to run simultaneously and with varying intervals. Each zone is totally and individually programmable and independent of the other zones in the system.

A lawn irrigation system that delivers too much water over a short duration causes water to runoff before it has a chance to soak into the ground. The present invention, when applied to lawn irrigation systems, allows for shorter run times so that the irrigation is blunted before it has a chance to reach an over-saturation point. Thus, the present invention can provide infinite cycling, a second time, or third time, etc. These additional light layers of irrigation water are applied in repeated cycles of smaller doses to avoid over-saturation and water run-off. This is a huge conservation aspect of the present invention when applied to lawn and landscape irrigation as often observed are rivers of runoff water in the streets during landscape irrigation. This is a huge conservation aspect of the present invention when applied to lawn and landscape irrigation as we've all seen the rivers of runoff water in the streets during landscape irrigation.

Another aspect of the present invention when used to control a lawn irrigation system is that the bypass feature as described above, is that the bypass feature can be turned off as it would not be needed in such an application since over pressurization protocols are already built into municipal water connections and irrigation pumps.

Another aspect of the present invention is that it could be used to remove debris from surfaces that tend to collect light debris such as leaves and twigs that fall on to the tops of carports, screened enclosures and other types of roofs. Powerful nozzles could be arranged in sequentially activated rows that emit high velocity jets of water, all fixed in position and directionally oriented to collectively move debris along a path until it falls from the given surface to the ground below. This could be hugely advantageous for several reasons. First, the accumulation of such foliage on a screened roof can build up to a point that it blocks and holds rainwater especially after finding its way to the gutter valley where the perpetual sogginess of the rotting foliage can cause rainwater to back up in the gutter valley leading to rot and mildew of the roof, facia and structural members of the roof system. It would also decrease the need for homeowners to risk injury by having to climb ladders and traverse the roof to clean the gutters and roof surfaces by hand. Another advantage would be to conserve water in that using a garden hose to try to blast away debris through the roof of a screened enclosure from below is substantially ineffective and time consuming thereby necessitating a greater volume of water to accomplish the same task.

Control Valves

One embodiment of the system of the invention utilizes solenoid actuated valves as described herein. The inventors have determined that different types of electronically controlled flow control valves will function effectively in the system of the invention. For example, a servo-actuated ball valve will also function well, in place of the solenoid actuated valves. In this alternative embodiment of the invention, an electronic signal activates a servo to open or close a ball valve to control the flow of pressurized water to each of the individual zones that make up the in-floor cleaning system.

Down Jets and Other Types of Water Emitters for Use in Certain Zones

The inventors have also determined that cleaning heads or nozzles previously described as having been mounted into the pool/spa floor during construction, can also be mounted, into the walls of the pool/spa, with standard wall mounted returns. These heads or nozzles are primarily tasked with maintaining water circulation and returning filtered water to the pool/spa. Other types of nozzles include fixed down jets for agitating dirt or debris that has settled onto the vessel's interior coves. Other types of water emitters may be added to the list of functional nozzles as they are developed and made available for installation in pools.

Additional Device Description and Theory of Operation

The device described here is a programmable control module for a swimming pool In Floor Cleaning System (IFCS). In-floor pop up jets are arranged into zones on the bottom of the swimming pool. Each zone is supplied water pressure by a solenoid actuated valve. The IFCS control module cycles opening and closing of the valves in a sequence that pushes debris toward the main drain of the swimming pool so that can be collected and removed from the bottom of the pool via the filtration system.

Theory of Operation

The IFCS control module works by supplying 24 VAC (in one embodiment) to solenoid valves in a defined sequence. Supplying the necessary power to the solenoid opens the valve and activates the zone. The zone stays active for a specified time duration that can be programmed by the user. Once the time interval for a given zone has elapsed, the next zone in the sequence is opened and the previous zone is closed by terminating power to the solenoid. Previously opened zones are closed after a time delay that can also be programmed by the user. The valve close delay prevents spikes in water pressure that would result from first closing a valve before opening the next valve. After stepping though all available zones, the unit cycles back to the first zone. This sequence continues indefinitely until power is cut to the unit.

For pumps that do not include over-pressure protection, the IFCS control module advantageously includes the capability to control a bypass valve. The bypass valve is of a "normally open" design, as opposed to the "normally closed" zone valves. When no zones are active, the bypass valve allows water to bypass the In-Floor Cleaning System zone valves, preventing an over pressure condition and damage to the pool equipment. When one or more zone valves are opened, the IFCS control module supplies 24 VAC to the bypass valve. This closes the bypass valve and directs the water flow into the zone valves. Upon power loss to the IFCS unit, the zone valves automatically close, and the bypass valve automatically opens.

Power

The IFCS control module activates and deactivates a series of electromechanical relays that switch 24 VAC. One embodiment uses an eight channel relay module and a two channel relay module, both available from Sainsmart of Lenexa, Kansas. The relay modules use +5 V active low control logic and a separate +5 V isolated power connection to the relay coils. Power and control circuits are isolated via optocouplers, one for each relay. The ten relays switch power supplied by a 120 VAC to 24 VAC (1000 mA maximum) transformer, supplying 24 VAC to each solenoid valve when active. The 24 VAC transformer also powers a 24 VAC-to-5 V DC converter.

The Mainboard power input terminals accept power from the 24 VAC to 5 V DC converter. This 5 V DC is input directly to the relay coils. The LCD backlight, and to the 5 V DC to 9 V DC voltage booster/isolator. The 9 VDC from the voltage booster/isolator is fed to the voltage regulator and the regulated voltage supplied to a microcontroller (such as an Arduino microcontroller, which requires an input voltage of 7-12 V DC. This is done to protect the logic circuitry since the 24 VAC to 5 V DC converter is not isolated from the AC power source. The voltage converter of the microprocessor board provides 5 V DC with polarity and over-current protection to all the logic circuitry as well as the microcontroller itself.

Control Logic

The Arduino Nano microcontroller board runs the IFCS software and can be programmed via a Mini-B USB connector integrated on the board. The microcontroller chip used on the Arduino Nano is an ATmega328, for use in one embodiment.

Text output from the software running on the microcontroller is displayed via a backlit 16×2 character LCD display (HD44780) connected to the Arduino's general-purpose digital I/O pins. Four momentary contact switches (buttons) are used for registering user input to the microcontroller. Each switch is connected to one of the Arduino Nano's general-purpose analog I/O pins and pulls the pin high when closed. The software polls the pin periodically to detect a closed switch.

The two 8-bit shift registers (74HC595) are connected in series to operate as one 16-bit shift register. This expands the output capabilities of the Arduino so that a total of ten parallel logic signals are sent to control both the eight and two channel relay modules. The relay modules use +5 V active low logic so relays not in use are held high (+5 V). The microcontroller activates a relay by pulling the corresponding control pin low (0 V).

Software

The controller software is written using the C programming language and requires three open source libraries. LiquidCrystal is used to interface with the LCD display. ShiftRegister74HC595 is used to simplify interaction with the 74HC595 shift registers. EEPROMex is used to provide data types for interacting the microcontroller's EEPROM memory.

The ten relays are controlled by setting shift register pins high (inactive) or low (active). Relays are activated sequentially by stepping through an array of integers representing target time intervals in seconds with wrap around. Relays are deactivated by stepping through an array of unsigned long integers representing start times with wrap around. The elapsed time for active relays is calculated by subtracting the current time from the start time. When the elapsed time for a given active relay has exceeded the target time interval plus the valve close delay, the relay is deactivated.

Settings are loaded from and saved to the microcontroller's EEPROM memory. Writing to the EEPROM occurs only when settings are explicitly saved, and then only when values to be written to EEPROM differ from those currently stored preventing excess wear from EEPROM writes. On boot up, all saved settings are automatically loaded from the EEPROM memory.

FIG. 1. illustrates a typical setup for a swimming pool in-floor cleaning system with six separate zones. Each zone carries pressurized water to an array of nozzles installed into the floor of a swimming pool and to one bypass path, usually a pool return, located in the pool wall. A pool circulation pump 28 receives recirculated water from a pool drain and from a pool skimmer (not shown). From the pump, the water travels under pressure to a filter 29 where physical matter (dirt and debris) is removed. The filter is fitted at its top, with an air bleed 30 to vent air from the vessel after cleaning. The filter is also fitted with a pressure gauge 32 to allow monitoring the pressure within the system.

From the filter, pressurized water then travels to an in-floor cleaning system manifold 34. The manifold is fitted with a water hammer arrestor 36 to reduce water hammer in the system. The first plumbing branch the pressurized water encounters upon entering the manifold is branch (zone) 37. This is the bypass path or zone equipped with a "normally open" solenoid actuated valve that holds this bypass valve closed while energized, but which defaults to the open position in the event power to a system controller is lost or an obstruction causes a pressure increase in the plumbing system. The former situation prevents a "dead head" or over pressurization situation in the event of a power failure while the pump 28 remains in operation.

The next six branches 40-45 are also referred to as zones 1 thru 6 (see FIG. 2), each equipped with a "normally closed" solenoid actuated valve 38 that when controlled to an opened state delivers pressurized water to zones 1 thru 6 as arranged in the pool floor, and/or spa floor, and/or steps and benches of either or both.

Each solenoid valve 38 is connected to an electronic controller 50 that programmatically controls the sequence and timing of the openings and closings (and thus duration) of all of the solenoid actuated valves within the system, including valves associated with each of the zone outlets and the bypass outlet. Control is accomplished by supplying control signals to the valves (or supplying power to the valves) whenever the controller has been manually or automatically activated while the pump is operative. Of course, if the pump is off the IFCS is also inoperative.

Figure 2:
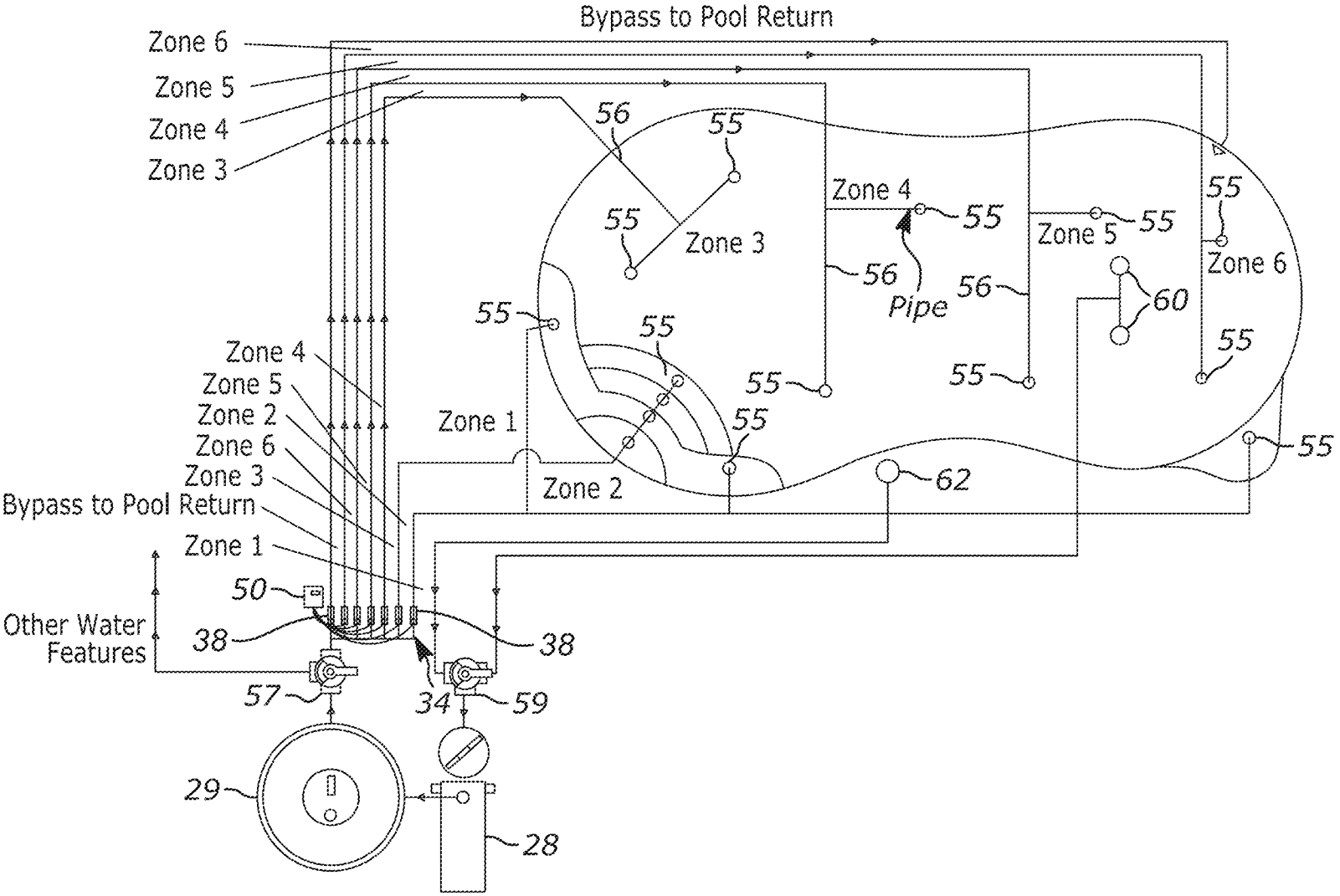
FIG. 2 represents a swimming pool in-floor cleaning system including a swimming pool with cleaning zones identified as controlled by a controller of the present invention.

FIG. 2 represents a swimming pool in-floor cleaning system comprising nozzles 55 connected by pipes 56. As shown, typically two nozzles are associated with each zone. The pump 28 forces water flow through the filter 29 and the IFCS; the water returns via the pool bottom main drains 60 and the skimmer 62. The pool water is filtered within the filter where it is cleaned of dirt and debris.

From the filter 29 the pressurized water travels to the manifold 34 comprising the six zones of the In-Floor Cleaning System (IFCS), as controlled by the electronic controller 50. Zones are directed to open (by operation of a zone valve 38) sequentially or in any desired opened/closed sequence. As controlled by the controller, the pressurized water is supplied to the nozzle(s) 55 of each of the six cleaning zones, causing each nozzle of each zone to rise up out of the floor, bench, or seat, and direct a stream of pressurized water across the surface of the floor, seat, or bench to agitate the water and thereby stir the dirt and debris into suspension where it can carried away to the drains or skimmer and then to the filter.

A manual valve 57 controls water flow from the filter 29 to other water features (not shown) of the swimming pool; a manual valve 59 controls the inflow of water from the main drains 60 and the skimmer 62 to the pump 28.

Figure 3:
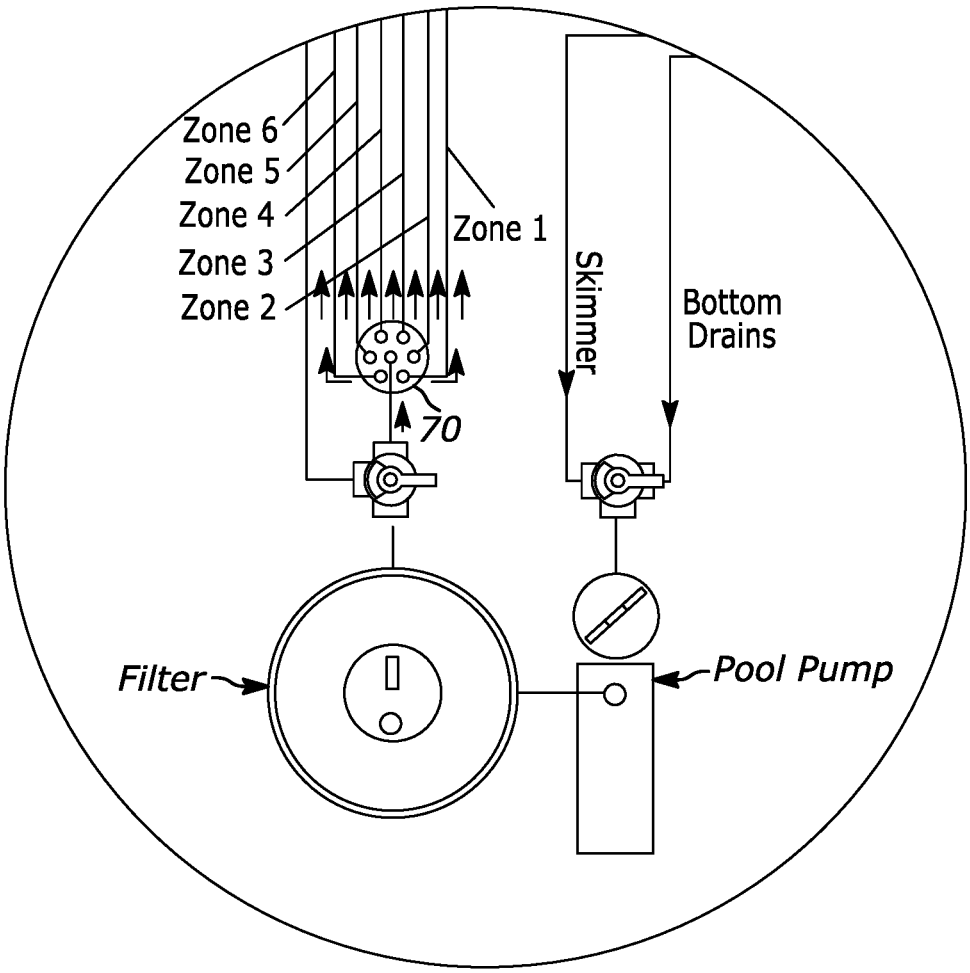
(Prior Art) FIG. 3
FIG. 3 represents a swimming pool equipped with six cleaning zones and a prior art mechanical (circular) distribution valve.

FIG. 3 represents a cleaning system comprising six cleaning zones and a mechanical (circular) distribution valve 70 of the prior art.

Figure 4:
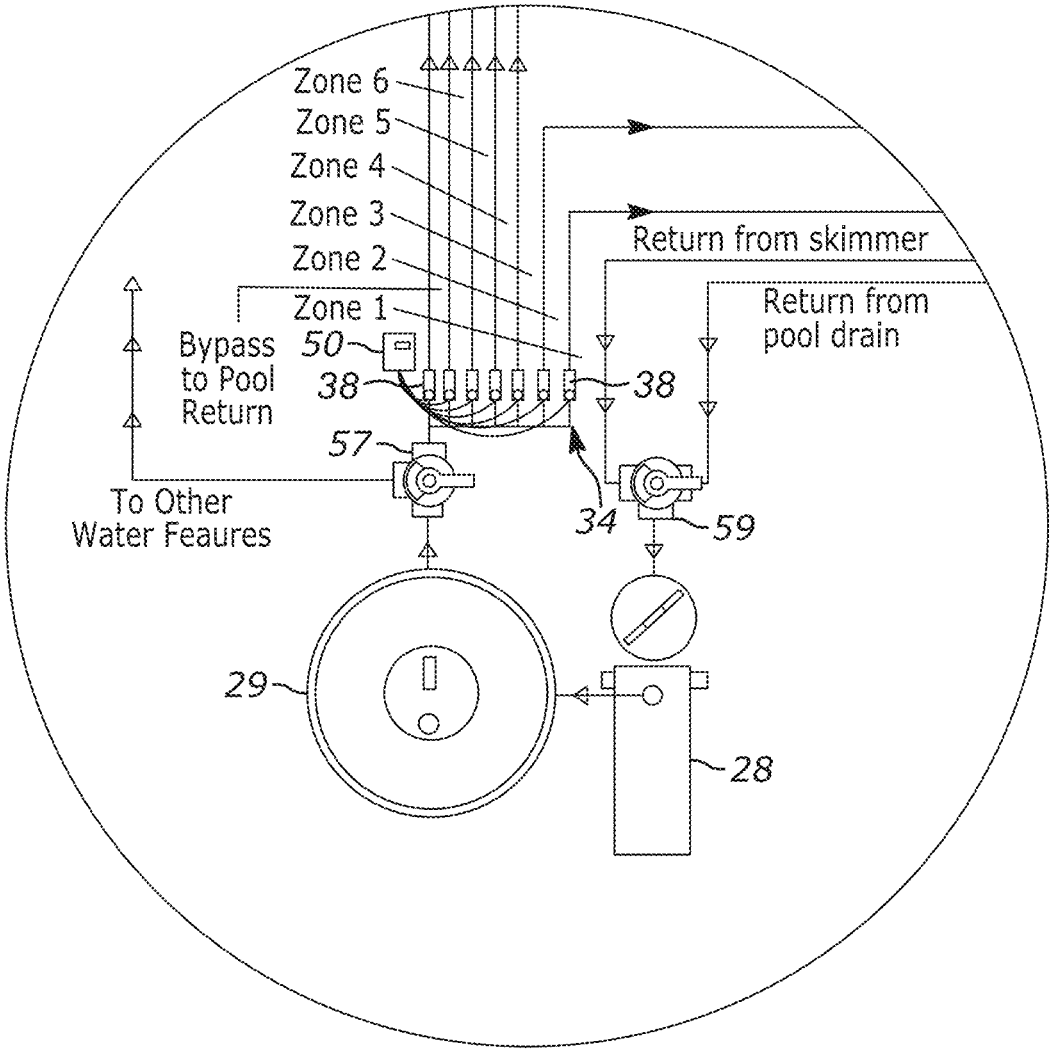
FIG. 4 represents a swimming pool equipped with six cleaning zones and a programmable electronics valve controller according to the teachings of the present invention.

FIG. 4 represents a swimming pool equipped with six cleaning zones and the programmable electronics valve controller 50, constructed according to the teachings of the present invention.

Figure 5:
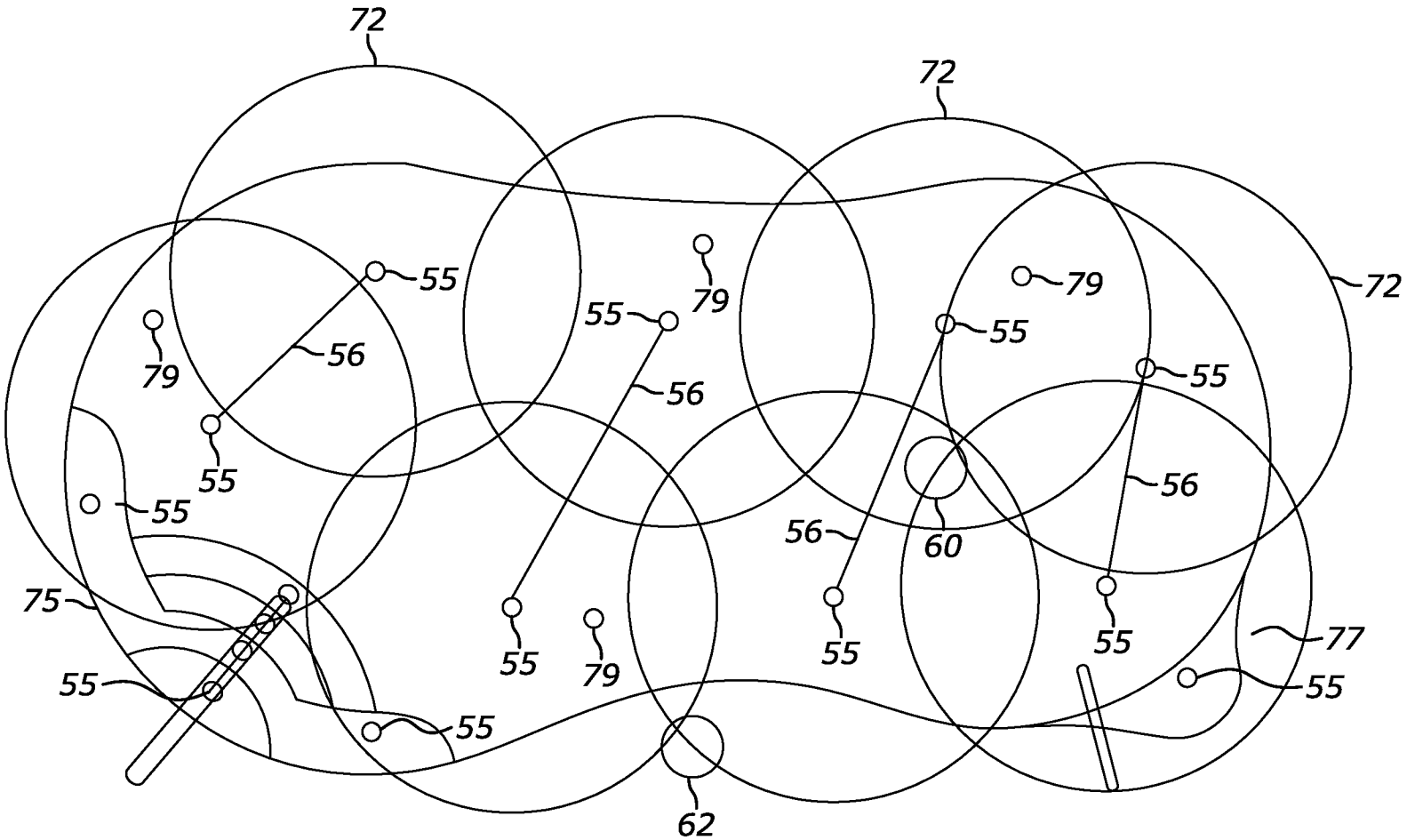
FIG. 5 represents a conventional swimming pool equipped with six cleaning zones where each nozzle is drawn with its appropriate cleaning radius.

FIG. 5 represents a swimming pool equipped with six cleaning zones where the cleaning radius 72 for each nozzle 55 is illustrated. Typically, two or three nozzles comprise a zone and the nozzles of a zone are connected by pipes 56. Each zone has a source pipe (not shown in FIG. 5) extending from the manifold (see FIG. 2) that supplies pressurized water to the nozzles of each zone. A step region 75 may have four nozzles (also referred to as heads) and those nozzles are typically tied to the nozzles in the swim out bench 77. The nozzles in the steps and swim out bench may be low flow nozzles with smaller orifices than those of the nozzles in the pool floor region. But the collective flow volume from the nozzles in the steps and swim out bench may be approximately equal to the flow volume for the nozzles in a floor zone. Sensors 79, disposed at various locations in the pool surfaces, provide a control signal to the controller 50 that augments or modifies the schedule that sets the opening and closing times and duration for each of the valves of the IFCS; the sensor control signal is responsive to the build-up of debris, leaves, dirt, etc. proximate the sensor.

Figure 6:
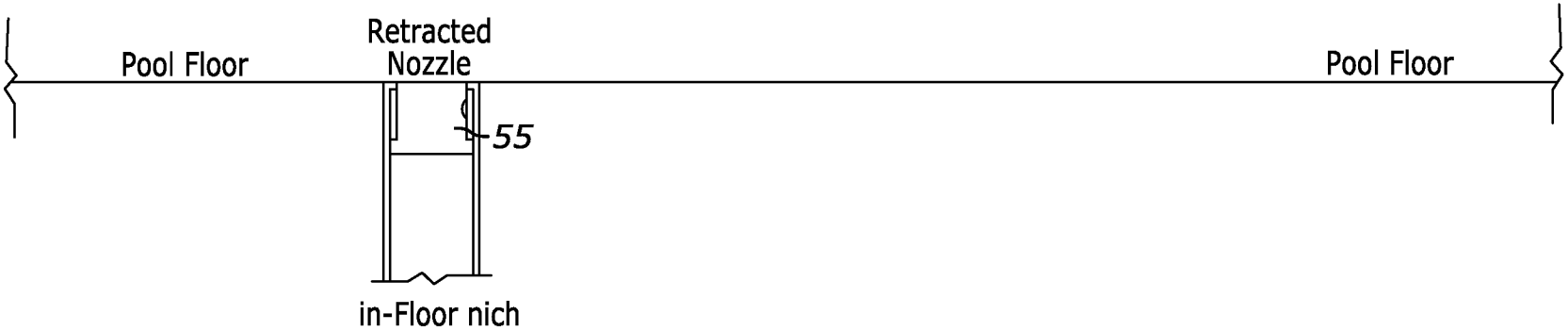
FIG. 6 represents a conventional floor cleaning nozzle in the retracted or inactive position.

FIG. 6 illustrates a floor cleaning nozzle 55 in a retracted or in-active position.

Figure 7:
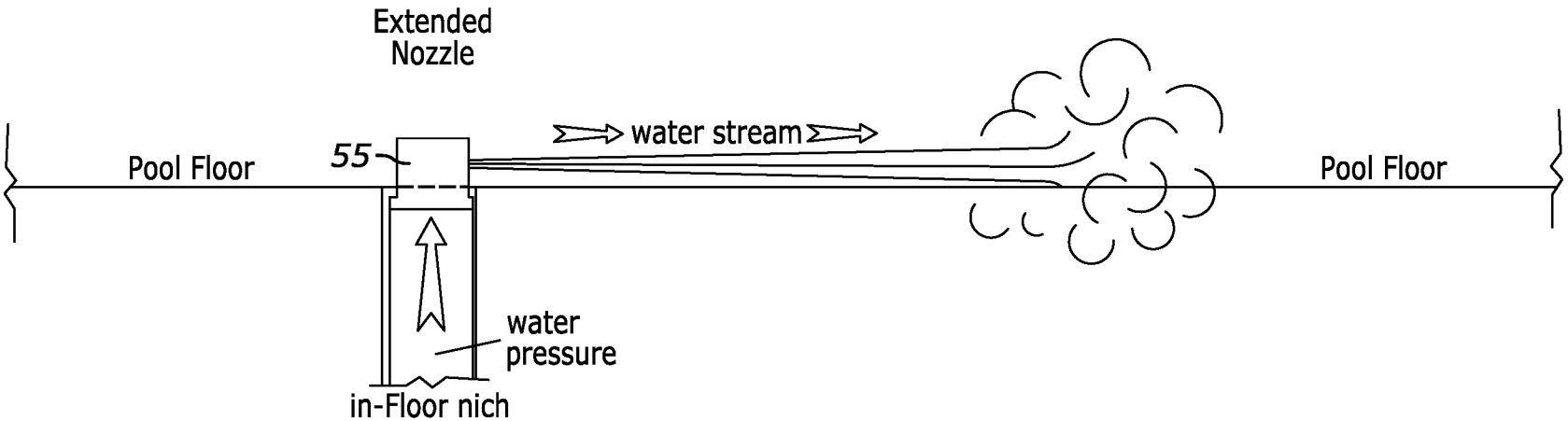
FIG. 7 represents a conventional floor cleaning nozzle in the fully extended or active position.

FIG. 7 illustrates a floor cleaning nozzle 55 in the fully extended or active position.

What is claimed is:

1. An in-floor pool cleaning system for controllably directing pressurized water from a pump to a pool or spa, the in-floor pool cleaning system comprising:

a plurality of zone outlets each one terminating at a nozzle disposed in a surface of the pool or spa, each zone outlet associated with a different surface region of the pool or spa;

a plurality of electronically-controllable normally-closed zone valves each associated with one of the plurality of zone outlets, a zone valve in an opened state allowing pressurized water to flow from the pump to the nozzle of the associated zone outlet, and wherein in the closed state no pressurized water is directed to the associated zone outlet;

a user-programmable controller for individually controlling each zone valve to the opened state and the closed state by controlling power or supplying a control signal to each zone valve according to a schedule;

wherein the controller is operative and supplying control signals to each valve according to the schedule only when manually or automatically activated and while the pump is operative;

wherein when the controller is deactivated the in-floor cleaning system is inoperative even when the pump is operative;

wherein the schedule for an opened-state, a closed-state, and an opened state duration for each zone valve is determined by a user, the controller, according to the schedule, providing for individual control of the opened and closed state of each zone valve irrespective of the opened and closed state of all other zone valves, such that more than one zone valve can be in the opened state simultaneously, and providing for an opened state for two zone outlets with overlapping surface regions of the pool or spa; and a normally-opened bypass outlet controllable to a closed state when one or more of the zone valves is in an opened state, in the opened state the bypass outlet supplying water to the pool or spa from the pump, the bypass outlet controllable to the opened state responsive to detection of a system over-pressurization or a system loss of power, wherein each one of the plurality of zone valves closes in response to a system loss of power.

2. The in-floor pool cleaning system of claim 1, wherein the zone valve comprises a solenoid actuated valve or a servo-actuated valve.

3. The in-floor pool cleaning system of claim 1, the schedule determinable on a daily basis, such that the schedule for a first day is different from a schedule for a second day.

4. The in-floor pool cleaning system of claim 1, wherein the zone valve associated with each zone outlet comprises a normally-closed valve and the valve associated with the bypass outlet comprises a normally-opened valve.

5. The in-floor pool cleaning system of claim 1, wherein the surface regions of the pool or spa comprise a floor surface, a steps surface, and a bench surface.

6. The in-floor pool cleaning system of claim 1, wherein an aperture in a nozzle through which the water flows is shaped such that the nozzle rotates through a sector less than 360 degrees each time the zone valve associated with a zone outlet is opened, wherein rotation through 360 degrees cleans a circular area of a surface region of the pool or spa.

7. The in-floor pool cleaning system of claim 1, wherein a surface region comprises a sidewall of the pool or spa.

8. The in-floor pool cleaning system of claim 1, wherein one of the nozzles comprises a directional nozzle for directing a water spray to only one surface region.

9. The in-floor pool cleaning system of claim 1, wherein an open duration of a zone valve is determined based on an expected concentration of debris within the surface region associated with the zone outlet controllable by the zone valve.

10. The in-floor pool cleaning system of claim 1, wherein while a first zone valve is in an opened state, the controller opening a second valve zone, and after a period of time closing the first zone valve.

11. The in-floor pool cleaning system of claim 10, wherein the period of time is programmable.

12. The in-floor pool cleaning system of claim 1, wherein a sequence for controlling each one of the plurality of zone valves sequentially opens certain zone valves such that debris within the pool or spa is moved toward a main drain.

13. The in-floor pool cleaning system of claim 1, wherein the controller is controllable from a site remote from the controller.

14. The in-floor pool cleaning system of claim 13, wherein the controller is controllable via a wi-fi or Bluetooth communications link.

15. The in-floor pool cleaning system of claim 1, the controller opens each zone valve individually according to a predetermined schedule and for a predetermined duration, since the nozzle terminating each zone outlet directs a water spray to a different sector of the zone whenever the respective zone valve is opened, over a period of time an entire surface region of the pool or spa is swept by the water spray.

16. The in-floor pool cleaning system of claim 1, wherein a duration of the opened and closed state for each zone valve is variable, such that a duration of the opened state for a first zone valve is different from a duration of the opened state for a second zone valve.

17. The in-floor pool cleaning system of claim 1, further comprising one or more sensors in the surface of the pool or spa, wherein one or more zone valves are opened responsive to output signals from the one or more sensors, the output signals indicating presence of debris proximate the sensor.

18. A method for cleaning surface regions of a pool or spa by controllably directing pressurized water from zone outlets to the surface regions, the method comprising:

electronically controlling a plurality of normally-closed zone valves, each associated with one of the like plurality of zone outlets, to an opened state to allow pressurized water to flow from a pump to a nozzle of the associated zone outlet, and wherein when a zone valve is in the closed state no pressurized water is directed to the associated zone outlet, wherein the nozzle is disposed in a surface of the pool or spa, and wherein each zone outlet is associated with a different surface region of the pool or spa;

while the pump is operative, automatically or manually controlling each zone valve to the opened state and the closed state by controlling power or supplying a control signal to each zone valve according to a schedule;

wherein the schedule for an opened-state, a closed-state, and an opened state duration for each zone valve is determined by a user, the controller, according to the schedule, providing for individual control of the opened and closed state of each zone valve irrespective of the opened and closed state of all other zone valves, such that more than one zone valve can be in the opened state simultaneously, further including activation of two zone outlets with overlapping surface regions of the pool or spa; and controlling a normally-opened bypass outlet to a closed state when one or more of the zone valves is in an opened state, such that in the opened state the bypass outlet supplying water to the pool or spa from the pump, controlling the bypass outlet to the opened state responsive to detecting a system over-pressurization or a system loss of power, wherein each one of the plurality of zone valves closes in response to a system loss or power.

* * * * *